US011143047B2

(12) United States Patent
Guivarc'h et al.

(10) Patent No.: US 11,143,047 B2
(45) Date of Patent: Oct. 12, 2021

(54) FAN INCLUDING A PLATFORM AND A LOCKING BOLT

(71) Applicant: SAFRAN AIRCRAFT ENGINES, Paris (FR)

(72) Inventors: Jeremy Guivarc'h, Moissy-Cramayel (FR); Fabrice Michel Francois Rene Aubert, Moissy-Cramayel (FR); Pierre Martin Michelsen, Moissy-Cramayel (FR)

(73) Assignee: SAFRAN AIRCRAFT ENGINES, Paris (FR)

( * ) Notice: Subject to any disclaimer, the term of this patent is extended or adjusted under 35 U.S.C. 154(b) by 236 days.

(21) Appl. No.: 16/446,669

(22) Filed: Jun. 20, 2019

(65) Prior Publication Data

US 2019/0390559 A1 Dec. 26, 2019

(30) Foreign Application Priority Data

Jun. 21, 2018 (FR) ..... 18 55479

(51) Int. Cl.
*F01D 11/00* (2006.01)
*F01D 5/32* (2006.01)
*F04D 19/00* (2006.01)

(52) U.S. Cl.
CPC ..... *F01D 11/008* (2013.01); *F01D 5/323* (2013.01); *F04D 19/002* (2013.01); *F05D 2240/80* (2013.01); *F05D 2260/30* (2013.01)

(58) Field of Classification Search
CPC ..... F01D 11/008; F01D 5/323; F01D 5/282; F01D 5/3007; F04D 19/002; F05D 2240/80; F05D 2260/30; F05D 2220/36; F05D 2300/6034
See application file for complete search history.

(56) References Cited

U.S. PATENT DOCUMENTS

2008/0226458 A1* 9/2008 Pierrot ..... F01D 11/008 416/220 R
2012/0275921 A1 11/2012 Steen et al.
(Continued)

FOREIGN PATENT DOCUMENTS

EP 2 837 774 A1 2/2015
FR 3 021 693 A1 12/2015
FR 3 029 563 A1 6/2016
(Continued)

OTHER PUBLICATIONS

French Preliminary Search Report dated Feb. 4, 2019 in Patent Application No. FR 1855479 (with English translation of categories of cited documents), 2 pages.

*Primary Examiner* — Christopher Verdier
*Assistant Examiner* — Eric A Lange
(74) *Attorney, Agent, or Firm* — Oblon, McClelland, Maier & Neustadt, L.L.P.

(57) ABSTRACT

A fan includes: a fan disc; an inter-blade platform including a base and a radial tab, a second orifice being formed in the tab of the platform; and a lock having a downstream edge configured to bear against the tab of the platform. The one among the downstream edge and the yoke of the fan disc includes a pin, the other includes a first orifice, the pin being configured to enter the first orifice and the second orifice so as to block the platform relative to the fan disc.

14 Claims, 4 Drawing Sheets

(56) References Cited

U.S. PATENT DOCUMENTS

| | | | | |
|---|---|---|---|---|
| 2014/0186187 | A1* | 7/2014 | Lamboy | F02K 3/06<br>416/219 R |
| 2015/0167209 | A1* | 6/2015 | Marchal | F01D 5/28<br>416/230 |

FOREIGN PATENT DOCUMENTS

| | | | |
|---|---|---|---|
| FR | 3 038 654 | A1 | 1/2017 |
| WO | WO 2013/160584 | A1 | 10/2013 |
| WO | WO 2014/092925 | A1 | 6/2014 |

* cited by examiner

FAN INCLUDING A PLATFORM AND A LOCKING BOLT

FIELD OF THE INVENTION

The invention relates to the general field of inter-blade platforms in the fans of the aeronautical turbomachines, in particular when these platforms are made of a composite material comprising a fibrous reinforcement densified by a matrix.

TECHNOLOGICAL BACKGROUND

A turbomachine fan comprises a rotor disc carrying a plurality of blades whose feet are engaged and retained in substantially axial grooves formed at the periphery of the disc. These blades are associated at their radially inner end with inter-blade platforms, which are disposed in the extension of the inlet cone.

The platforms make it possible in particular to delimit, on the inner side, the annular flow path of air intake in the fan, this flow path being delimited on the outer side by a casing. These platforms generally comprise a base configured to delimit the flow path and a box extending radially inwards, from the base in order to allow bearing of the platform on the fan disc. The box is further configured to stiffen the platform in order to ensure the continuity of the aerodynamic flow in the fan.

It is known to make the inter-blade platforms of the fans for example of composite material. The composite material generally comprises a fibrous reinforcement densified by a matrix. Depending on the intended application, the preform may be made of glass fibers, carbon or ceramic and the matrix may be made of organic (polymer) material, carbon or ceramic. For workpieces of relatively complex geometric shape, it is also known to make a fibrous structure or blank in one piece by three-dimensional or multi-layer weaving and to shape the fibrous structure in order to obtain a fibrous preform having a shape close to that of the workpiece to be manufactured.

The performance and integration requirements are reflected in a good control of the sealing of the fan blade root. This sealing is directly piloted by the ability to encircle the blade root by the platforms at any point of operation. Until a certain clearance, it is possible to fill this clearance with the use of a seal. Beyond that, it is no longer possible to provide a sealing.

The performance and integration requirements are also reflected in an ability to decrease the hub ratio, which corresponds to the ratio between the inner radius to the outer radius of the aerodynamic flow path, where the inner radius corresponds to the distance between the axis of revolution of the fan and the surface of the platform that delimits the flow path, at the leading edge of the fan blade, and the outer radius corresponds to the distance between the axis of revolution of the fan and the fan casing, at the same level of the blade (namely at the leading edge of the blade, at the intersection with the platform). The lower the hub ratio, the more the fan will be efficient.

The reduction of this hub ratio often requires having to reduce the force passing upstream of the platform and to resume part of this force elsewhere on the disc. With fixed disc plane, axis of revolution and aerodynamic flow path, the hub ratio will be a function of the distance (height) between the surface of the platform that delimits the flow path and the radial face of the fan disc. Particularly, if this height increases, the hub ratio increases.

For example, document US 2012/0275921 illustrates a fan disc in which the platform is resumed upstream and downstream. However, the upstream attachment is bulky so as to allow resumption of the centrifugal forces, which implies a hub ratio that it may be interesting to decrease.

Document US 2014/0186187, for its part, proposes to resume part of the centrifugal forces on an extension protruding from a downstream part of the disc. Such a configuration makes it possible to reduce the bulk of the attachment in the upstream part, and therefore to reduce the hub ratio. However, this configuration can degrade the flowing of air by the presence of cavities at the screw hole or of a poor control of the surface appearance.

It has also been proposed in document FR 3 029 563 on behalf of the Applicant to assemble the platform on a pin machined in the mass of the disc. However, the larger the rope of the fan blade, the more the curvature of the blade will be pronounced and the more the clearance required for the axial assembly of the fan blade will be significant. This configuration therefore requires a sufficient clearance that may prove be too significant to be filled according to the configurations for allowing axial assembly of the platform, which is reflected in an opening of the clearances at the trailing edges in the extrados of the fan blades.

SUMMARY OF THE INVENTION

An object of the invention is therefore to propose a fan having the lowest possible hub ratio, in which the inter-blade platforms can be easily attached to the fan disc without degrading the flow path, regardless of the shape of the flow path they define, while limiting the clearances necessary for the assembly of the fan blades.

For this purpose, the invention proposes a turbomachine fan having an axis of revolution and comprising:

- a fan disc having an upstream face, a radial face configured to receive a series of fan blades and a yoke extending radially with respect to the axis of revolution from the radial face,
- an inter-blade platform, said platform comprising:
  - a base having a first surface configured to delimit a flow path in the fan and a second surface opposite to the first surface,
  - a tab extending radially with respect to the axis of revolution on the side of the second surface, and
- a lock having a downstream edge configured to bear against the tab of the platform, one among the downstream edge of the lock and an upstream face of the yoke of the fan disc comprising a pin, a first orifice being formed in the other one among the downstream edge of the lock and the upstream face of the yoke of the fan disc, and a second orifice being formed in the tab of the platform, the pin being configured to enter the first orifice and the second orifice so as to block the platform relative to the fan disc.

Some preferred but non-limiting characteristics of the fan described above are as follows, taken individually or in combination:

- the pin extends from the downstream edge of the lock, the first orifice being formed in the upstream face of the yoke.
- the tab extends between the downstream edge of the lock and the upstream face of the yoke.
- the base and the tab are formed integrally and in one piece.

the base and the tab are made of a composite material comprising a fibrous reinforcement densified by a polymer matrix.

the lock is metallic, preferably made of titanium, steel or Inconel.

the first orifice and the second orifice are through orifices.

the base of the platform has an upstream end in which a through passage is formed and the lock comprises an upstream edge configured to enter the passage when the downstream edge bears against the tab of the platform.

at the upstream face of the disc, the upstream edge of the lock extends in the extension of the radial face.

at least one groove is formed in the radial face of the disc, said groove opening on the upstream face of the disc and the upstream edge of the lock being bent so as to conform to the shape of the groove.

the fan further comprises a blocking shroud added and attached, on the one hand, to the upstream end of the base of the platform and, on the other hand, to the upstream face of the fan disc.

the fan further comprises an inlet cone added and attached to the blocking shroud.

BRIEF DESCRIPTION OF THE DRAWINGS

Other characteristics, objects and advantages of the present invention will become more apparent upon reading the following detailed description, and in relation to the appended drawings given by way of non-limiting examples and in which.

DETAILED DESCRIPTION OF ONE EMBODIMENT

Figure 1:
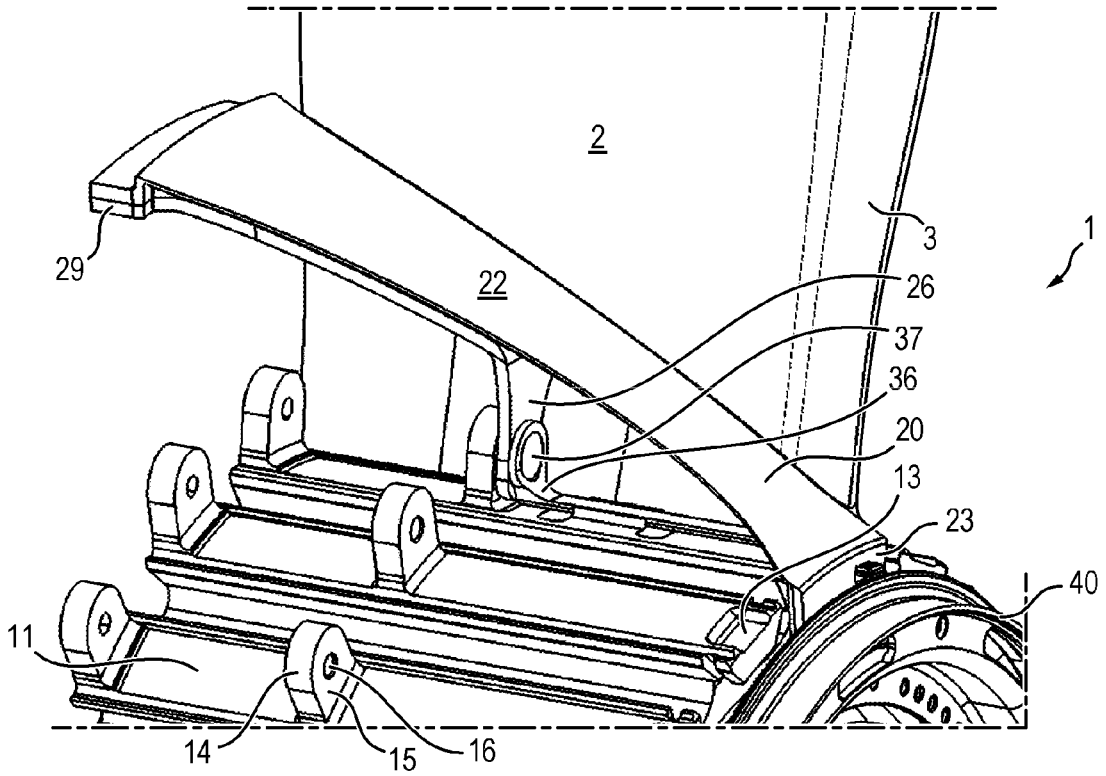
FIG. 1 is a perspective view of a fan section according to one embodiment.

In the present application, the upstream and downstream are defined with respect to the normal flowing direction of the gas in the fan 1 through the turbomachine. Furthermore, the axis X of radial symmetry of the fan 1 is called axis of revolution of the turbomachine fan 1. The axial direction corresponds to the direction of the axis X of the fan 1, and a radial direction is a direction perpendicular to this axis and passing therethrough. Similarly, an axial plane is a plane containing the axis X of the fan 1 and a radial plane is a plane perpendicular to this axis X and passing therethrough. Unless otherwise specified, the terms inner and outer, respectively, are used with reference to a radial direction so that the inner (i.e. radially inner) part or face of an element is closer to the X-axis than the outer (i.e. radially outer) part or face of the same element.

A turbomachine fan 1 comprises a fan 1 disc 10 carrying a plurality of fan blades 2 associated with inter-blade 2 platforms 20.

The blades 2 are engaged in axial grooves formed in a radial face 11 of the fan 1 disc 10, corresponding to the outer circumferential face of the disc 10. The fan 1 disc 10 further comprises a yoke 14 extending radially from the radial face 11. The yoke 14 is formed integrally and in one piece with the fan 1 disc 10, for example by machining.

In a first embodiment, a first orifice 16 is formed in the yoke 14. The first orifice 16 is axial and has an axis of revolution X substantially parallel to the axis of revolution X of the fan 1. The first orifice 16 opens at least into the upstream face 15 of the yoke 14. Optionally, the first orifice 16 is a through orifice.

Each blade 2 has a foot engaged in one of the grooves, a head (or vertex), a leading edge 3 and a trailing edge. The leading edge 3 is configured to extend with respect to the flowing of the gases entering the turbomachine. It corresponds to the anterior part of an aerodynamic profile that faces the air flow and divides the air flowing into an intrados flowing and an extrados flowing. The trailing edge, for its part, corresponds to the posterior part of the aerodynamic profile, where the intrados flowing and extrados flowing meet.

The blades 2 are associated, at their radially inner end, with inter-blade 2 platforms 20, which are disposed in the extension of an inlet cone 50.

Each platform 20 includes a base 22 and a tab 26.

The base 22 has a first surface 22*a* configured to delimit, radially inwards, the flow path in the fan 1 and a second surface 22*b* opposite to the first surface 22*a*.

The tab 26 extends radially with respect to the axis of revolution X on the side of the second surface 22*b* of the base 22. A second orifice 28, whose axis of revolution X is substantially parallel to the axis of revolution X of the fan 1, is formed in the tab 26.

The tab 26 is configured to come into contact with the yoke when the platform 20 is attached on the fan 1 disc 10, so that the second orifice 28 of the tab 26 is facing the first orifice 16 of the yoke 14. The second orifice 28 is a through orifice.

The fan 1 further includes, for each platform 20, a lock 30 having a downstream edge 36 configured to bear against the tab 26 of the platform 20 and an upstream edge 32 configured to cooperate with the base of the platform 20. In the first embodiment, the downstream edge 36 of the lock 30 is provided with a pin 37 configured to enter the first orifice 16 and the second orifice 28 so as to axially and radially block the platform 20 relative to the fan 1 disc 10. For this purpose, the downstream edge 36 of the lock 30 is formed of a radially extending wall having a downstream radial face from which the pin 37 protrudes. The pin 37 is, in the embodiment illustrated in the figures, formed integrally and in one piece with the downstream edge 36 of the lock 30. Alternatively, the pin 37 may be added to the downstream edge 36.

It will, of course, be understood that, in an equivalent manner, the invention also covers a second embodiment (not illustrated in the figures) in which the pin 37 extends axially upstream of the yoke 14 of the fan 1 disc 10, the first orifice 16 then being formed in the downstream edge 36 of the lock 30. Apart from this inverted configuration of the pin assembly, the other parts of the fan 1 are unchanged.

The combination of the lock 30, the yoke 14 and the tab 26 makes it possible to axially and radially attach the platform 20 on the fan 1 disc 10 in a simple, efficient and fast manner, while allowing a low hub ratio to be obtained. In addition, the axial position of the tab 26 can be determined and accurately attached, independently of the material constituting the platform 20, since it is pressed axially against the downstream edge 36 of the lock and against the yoke of the disc 10, which both can be accurately machined.

In one embodiment, the pin 37 can be pre-assembled on the platform 20 and then locked after placing the platform 20 on the disc 10.

The platform 20 has an upstream end 23 configured to cooperate with the upstream edge 32 of the lock 30 and a downstream end 29 configured to face a workpiece extending downstream of the fan 1. Generally, the downstream workpiece of the fan 1 comprises an inner shroud of an IGV (acronym for Inlet Guide Vane, that is to say the first stator stage of the booster in the primary body of a turbomachine) or, alternatively, a rotating spacer which is formed of an annular flange extending between the fan 1 and the inner shroud of the IGV and which rotates at the same speed as the fan 1 disc 10. The downstream end 29 of the base 22 of the platform 20 and this workpiece (whether it is the inner shroud of the IGV or the rotating spacer) are then shaped so as to extend in the extension of one another so as to limit the cavities at the inlet to the primary body of the turbomachine likely to disturb the primary flowing.

A through passage 21 is formed in the upstream end 23 of the base 22 of the platform 20 and is configured to receive the upstream edge 32 of the lock 30, when its downstream edge 36 is bearing against the tab 26 of the platform 20 and the plate against the upstream face 15 of the yoke 14. In operation, the upstream edge 32 therefore enters the passage 21. Where appropriate, the upstream edge 32 of the lock 30 can cross the passage 21 and protrude from the upstream end 23 of the base 22.

In one embodiment, the upstream edge 32 of the lock 30 extends in the extension of the radial face 11 of the disc 10 or at least of the portion of the disc 10 which opens on the upstream face 12. Where appropriate, a through orifice can be formed in the upstream edge 32 of the lock in order to allow the passage of a disassembly tool for axially sliding the lock on the upstream side.

Figure 4:
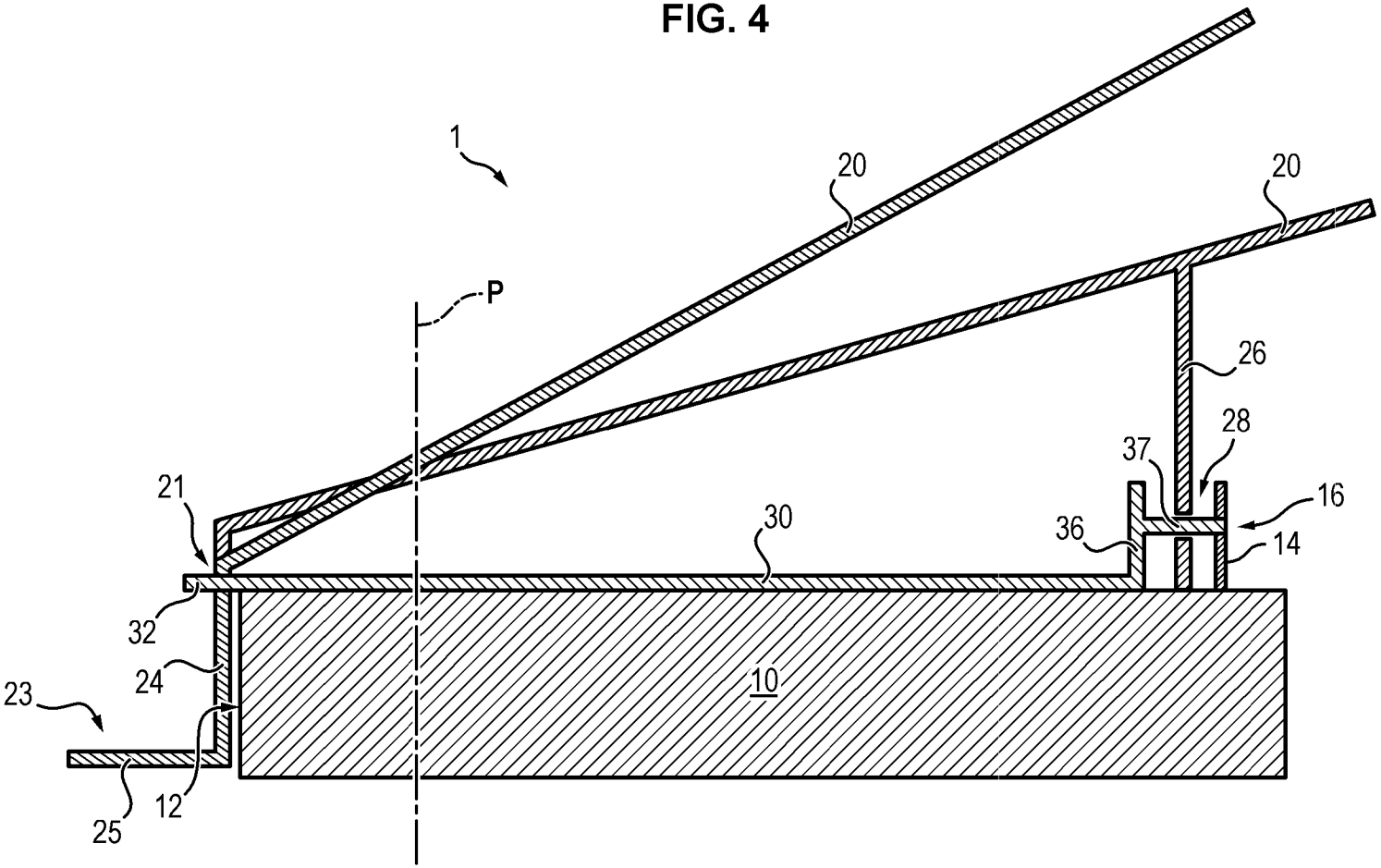
FIG. 4 is a schematic partial sectional view of an example of embodiment of a fan on which two platform shapes have been illustrated.

This configuration of the lock 30, and particularly the configuration of its upstream edge 32, allows the lock 30 to become "multi-functional" in the sense that it conforms to many shapes of platforms 20. It will be in particular possible to refer to FIG. 4, which illustrates very schematically two examples of platform 20, one having a gentle "slope" (inclination relative to the axis of revolution) while the other having a steep "slope" and forming a more aggressive flow path. As visible in this figure, in these two configurations, the base 22 of the platform 20 passes through the same radius at the plane P of the fan. However, this plane P of the fan corresponds here to the plane normal to the axis of revolution X of the fan passing through the root of the fan blades 2 at their leading edge 3. It is therefore the plane at which the hub ratio is measured. It can be deduced that these two platform configurations have the same hub ratio.

Furthermore, the axial stroke of the assembly of the platform 20 on the disc 10 can be reduced to a minimum and correspond substantially to the distance between the upstream face 12 of the disc 10 and the upstream face 15 of the yoke 14.

The upstream end 23 of the base 22 of the platform 20 is bent and includes a first portion 24 which extends radially inwards, on the side of the second surface of the base 22 so as to extend along the upstream face 12 of the disc 10, and a second portion 25 which extends axially from the first portion 24 and which is configured to cooperate with a blocking shroud 40. The passage 21 is formed in the first portion 24 of the upstream end 23 of the base 22.

The upstream end 23 of the base 22 of the platform 20 therefore extends upstream with respect to the upstream face 12 of the fan 1 disc 10 and radially inwards with respect to the radial face 11 of the disc 10. Where appropriate, the platform 20 can be brought into abutment against the upstream face 12 of the disc 10, which makes it possible to improve the stiffness of the platform 20.

The combination of the upstream edge 35 of the lock 30 extending in the extension of the radial face 11 of the disc 10, and of the upstream end 23 of the base 22 which extends along the upstream face 12 of the disc 10 makes it possible to obtain a fan 1 at low hub ratio without degrading the clearance at the trailing edge nor the quality of the flow path.

Figure 3:
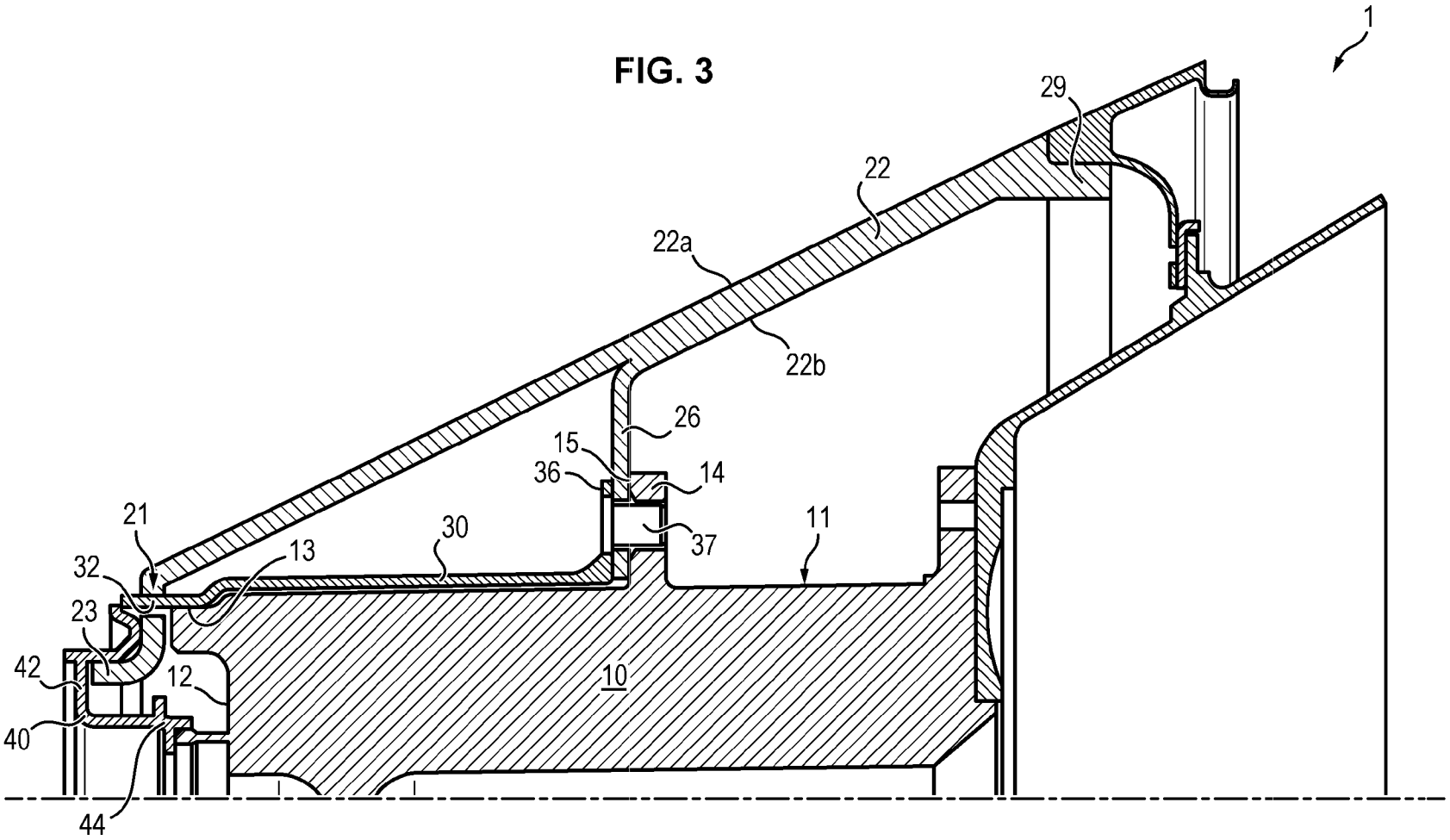
FIG. 3 is a sectional view of FIG. 1 when the pin of the lock is engaged in the yoke.

Optionally, the hub ratio can further be reduced by forming a groove 13 in the radial face 11 of the disc 10, which opens at its upstream face 12, and by conforming to the upstream edge 35 of the lock 30 so that it follows the shape of the radial face 11 of the disc 10 at its upstream part. For example, the upstream edge 35 of the lock 30 can be bent so as to match the shape of the groove 13 (FIG. 3). This particular shape of the upstream edge 35 of the lock 30, which is allowed by the formation of the groove 13 in the disc 10, thus makes it possible to offset radially inwards the upstream end 23 of the base 22 of the platform 20, and therefore to further reduce the hub ratio of the fan 1. The height between the first surface 22*a* of the base 22 of the platform 20, which delimits the flow path, and the radial face 11 of the fan 1 disc 10 can indeed be small (in the order of a few millimeters). Particularly, the deeper the groove 13 formed in the disc 10, the smaller this height and therefore the lower the hub ratio.

Figure 2:
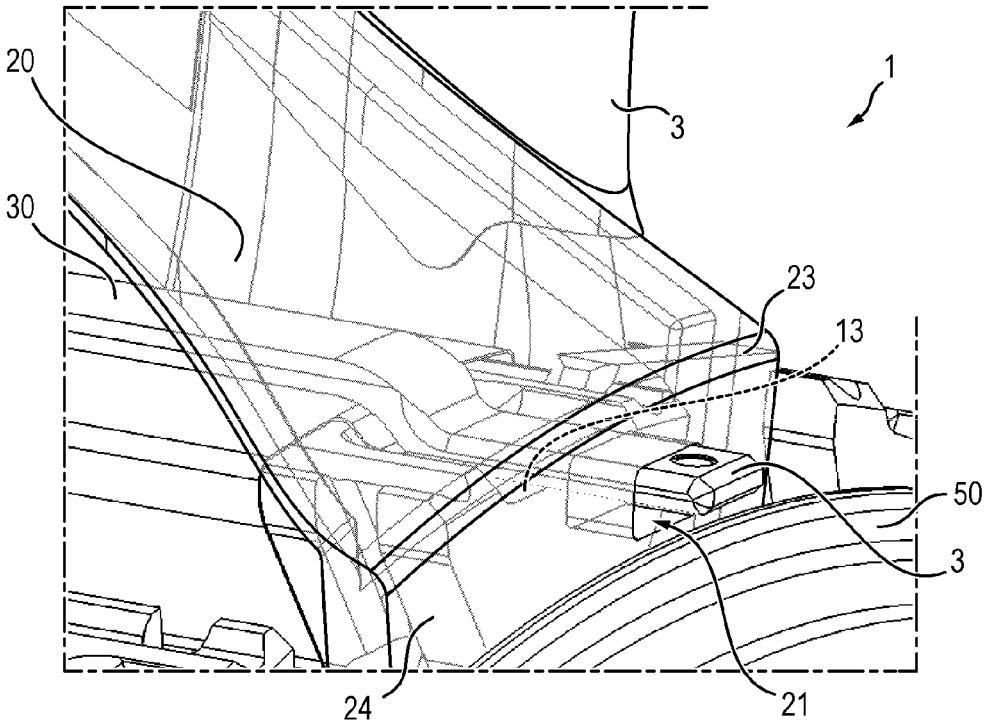
FIG. 2 is a detailed view of the upstream part of the fan of FIG. 1 when the lock is pressed against the radial face of the fan disc.

The groove 13 may be annular. Alternatively, several grooves 13 can be formed in the radial face 12 of the disc 10. Where appropriate, the disc 10 may include as many grooves 13 as platforms 20 (see FIGS. 1 and 2) or the same groove 13 may be shared by several platforms 20.

The fan 1 further comprises the blocking shroud 40 and the inlet cone 50.

The blocking shroud 40 is added and attached, on the one hand, to the upstream end 23 of the base 22 of the platform 20 and, on the other hand, to the upstream face 12 of the fan 1 disc 10 in order to block the lock 30 against the upstream face 12 of the fan disc 10. The blocking shroud 40 therefore ensures holding in position and radially centering the platform 20, by blocking the axial movements of the lock 30. The blocking shroud 40 may for example comprise a clamp 42 configured to bear on the radially outer face of the upstream end 23 of the base 22 and a lug 44 configured to be inserted into a corresponding housing formed in the upstream face 12 of the fan 1 disc 10 and blocked in this position by locking means such as a screw and a bolt.

The inlet cone 50, for its part, is added and attached to the blocking shroud 40, so as to extend in the extension of the base 22 of the platform 20 by limiting the cavities likely to disturb the flowing at the inlet of the fan 1. In the example of embodiment illustrated in the figures, the inlet cone 50 covers the upstream end 23 of the base 22 and the blocking shroud 40. Alternatively, the blocking shroud 40 could comprise a part covering the upstream end 23 of the base 22 and extend in the extension of the radially outer surface of the base 22. In this case, the inlet cone 50 extends in the extension of the blocking shroud 40, without covering it.

The tab 26 and the base 22 of each platform 20 are formed integrally and in one piece.

In one embodiment, the tab 26 and the base 22 can be made of a composite material comprising a fibrous reinforcement densified by a polymer matrix.

The fibrous reinforcement can be formed from a fibrous preform obtained by three-dimensional weaving with variable thickness. It may in particular comprise carbon, glass, aramid and/or ceramic fibers. The matrix, for its part, is typically a polymer matrix, for example epoxy, bismaleimide or polyimide matrix. The blade 1 is then formed by molding by means of a vacuum resin injection process of the RTM (for "Resin Transfer Molding") or VARTM (for Vacuum Resin Transfer Molding) type.

Figure 5:
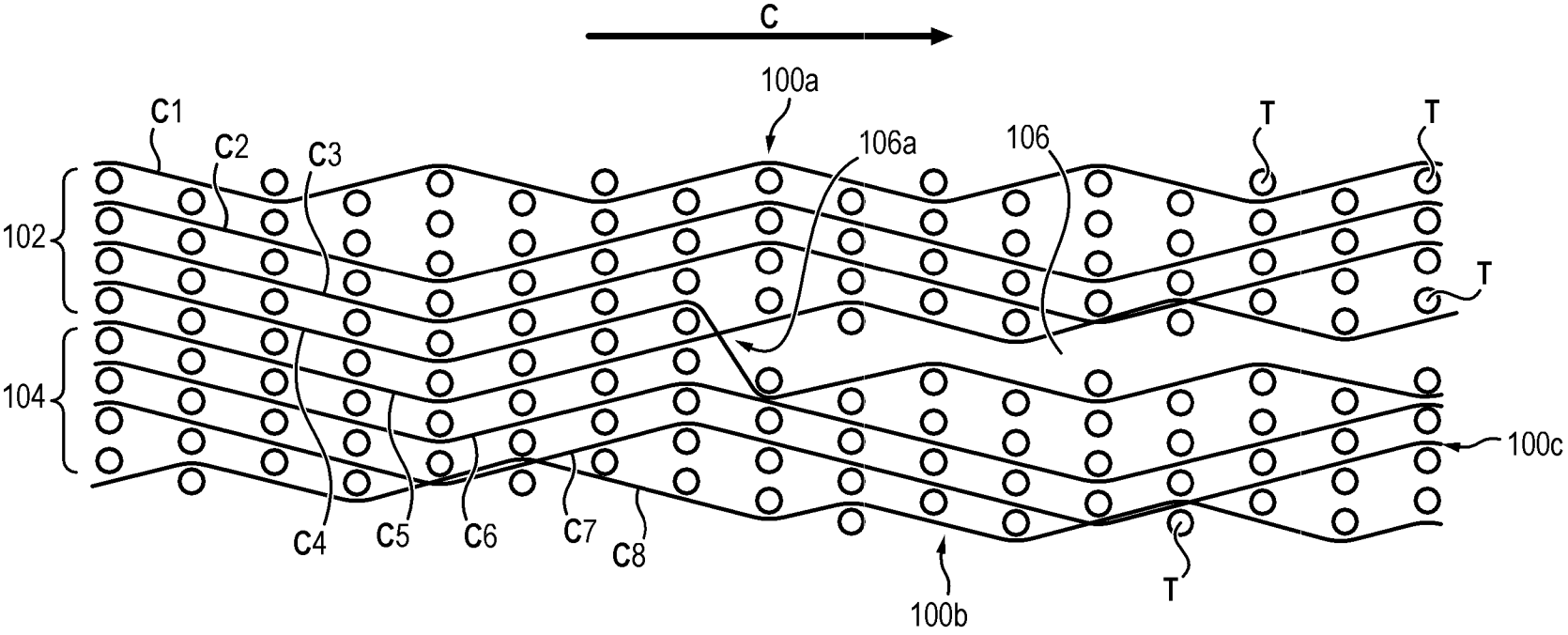
FIG. 5 is a schematic view of an example of a three-dimensional woven fibrous blank according to one embodiment of the invention.

In order to make the base 22 and the tab 26 in one piece, a non-interlinked open zone can be formed so as to allow, from the same three-dimensional preform, making these two parts of the platform 20. Reference will in particular be made to FIG. 5, that schematically represents a warp plane of a three-dimensional woven fibrous blank from which a fibrous preform of the platform 20 can be shaped, before resin injection or densification by a matrix and possible machining, in order to obtain a fan 1 platform 20 made of composite material such as the one illustrated in FIGS. 1 to 4. By three-dimensional weaving, it will be understood that the $C_1$-$C_8$ wrap strands follow sinuous paths in order to link together weft T yarns belonging to layers of different weft yarns except for non-interlinked zones 106, being noted that a three-dimensional weaving, in particular with interlock weave, may include 2D weavings on surface. Different three-dimensional weaving patterns can be used, such as interlock, multi-satin or multi-veil interlock weaves, for example, as described in particular in document WO 2006/136755. In FIG. 5, the fibrous blank has two opposite surfaces 100*a*, 100*b* and comprises a first part 102 and a second part 104. These two parts 102, 104 form respectively a first and a second part of the thickness of the fibrous blank between its opposite surfaces 100*a*, 100*b*.

Each part 102, 104 of the fibrous blank comprises a plurality of superimposed layers of weft T yarns, four in the illustrated example, the number of weft T yarns can be any desired number at least equal to two depending on the desired thickness. In addition, the numbers of weft yarn layers in the parts 102 and 104 may be different from each other. The weft T yarns are disposed in columns each comprising weft T yarns of the first and second parts 102, 104 of the fibrous blank. On a portion of the dimension of the fibrous blank in a C wrap direction, the first part 102 and the second part 104 of the fibrous blank are totally separated from one another by a non-interlinked open zone 106 which extends from an upstream limit 106*a* up to a downstream edge 100*c* of the fibrous blank. By non-interlinked open zone 106, is meant here a closed area at one end and open at an opposite end which is not crossed by $C_1$-$C_8$ wrap yarns linking together weft T layers respectively belonging to two of the layers, in the example here the second part 104 and the second part 104 of the fibrous blank.

Apart from the non-interlinked open zone 108, the layers of weft T yarns are linked together by warp yarns of a plurality of layers of $C_1$-$C_8$ warp yarns. In the example more specifically illustrated in FIG. 5, the same first $C_4$ warp yarn links together layers of weft T yarns of the first part 102 of the fibrous blank adjacent to the non-interlinked zone 106 and layers of weft T yarns of the second part 102 of the fibrous blank beyond the non-interlinked zone 106, that is to say before the upstream limit 106*a*. Of course, this linking could be made by several first warp yarns.

Conversely, the same second $C_5$ warp yarn links together layers of weft T yarns of the second part 104 of the fibrous blank adjacent to the non-interlinked open zone 106 and layers of weft T yarns of the first part 102 of the fibrous blank beyond the non-interlinked closed zone. Of course, this linking could be made by several second warp yarns. Thus, the path of the $C_5$ warp yarn and that of the $C_6$ warp yarn intersect at the upstream limit 106*a* of the non-interlinked open zone 106.

The fibrous preform 10 therefore comprises, in the direction of the C warp yarns, a first portion 24 in which the first part 102 and the second part 104 are securely attached so as to form, after injection of the matrix, the downstream part of the platform 20, and a second portion 25 extending between the upstream limit 106*a* of the non-interlinked zone 106 and the downstream edge 100*c* of the preform, intended to form the upstream part of the base 22 and tab 26. For this purpose, it suffices, after weaving, to separate the two parts 102 and 104 and to give them the desired shape (and more particularly to form an angle between the isolated portion of the first part 102 of the preform intended to form the base 22 and the isolated portion of the second part 104 of the preform intended to form the tab 26), then to place the preform in the desired configuration in a suitable mold in order to inject therein the matrix under vacuum, in accordance with the commonly used processes (for example by process of the RTM or VARTM type).

The second orifice 28 can then be made by machining in the tab 26. In a non-represented variant, this orifice could come from an insert co-molded with the tab 26.

The thickness of the upstream part of the base 22 and tab 26 of the platform 20 can be determined by choosing the number of layers in the first part 102 and the second part 104, respectively, as well as the number and the diameter (tex) of the strands in the warp and weft yarns in each of these parts. The thickness of the upstream part may therefore be different from that of the downstream part.

The lock 30 is metallic, preferably made of titanium, steel or Inconel (such as Inconel 425) in order to ensure an accurate machining of the workpiece and a low mass.

The invention claimed is:

1. A fan for a gas turbine engine comprising:

a fan disc having an upstream face, a radial face configured to receive a series of fan blades and a yoke extending radially from the radial face, an inter-blade platform, said platform comprising:

a base having a first surface configured to delimit a flow path in the fan and a second surface opposite to the first surface, and a tab extending radially with respect to an axis of revolution of the fan disc, the tab being adjacent to the second surface, and a lock having a downstream edge extending radially with respect to the axis of revolution of the fan disc, the downstream edge of the lock configured to bear against the tab of the platform, wherein one of the downstream edge of the lock and an upstream face of the yoke comprises a pin, a first orifice being formed in the other one among the downstream edge of the lock and the upstream face of the yoke of the fan disc, wherein a second orifice is formed in the tab, wherein the pin is configured to enter the first orifice and the second orifice so as to block motion of the inter-blade platform with respect to the fan disc, wherein the base of the inter-blade platform has an upstream end in which a through passage is formed, and wherein the lock comprises an upstream edge configured to enter the through passage when the downstream edge of the lock bears against the tab.

2. The fan according to claim 1, wherein the pin extends from the downstream edge of the lock, the first orifice being formed in the upstream face of the yoke.

3. The fan according to claim 1, wherein the tab extends between the downstream edge of the lock and the upstream face of the yoke.

4. The fan according to claim 1, wherein the base and the tab are formed integrally and in a single piece.

5. The fan according to claim 1, wherein the base and the tab are made of a composite material comprising a fibrous reinforcement densified by a polymer matrix.

6. The fan according to claim 1, wherein the lock is metallic.

7. The fan according to claim 1, wherein the first orifice and the second orifice are through orifices.

8. The fan according to claim 1, wherein, at the upstream face of the fan disc, the upstream edge of the lock extends in an extension direction of the radial face.

9. The fan according to claim 8, wherein at least one groove is formed in the radial face of the fan disc, said groove opening on the upstream face of the fan disc and the upstream edge of the lock being bent so as to conform to the shape of the groove.

10. The fan according to claim 1, further comprising a blocking shroud added and attached to the upstream end of the base of the inter-blade platform and to the upstream face of the fan disc.

11. The fan according to claim 10, further comprising an inlet cone added and attached to the blocking shroud.

12. The fan according to claim 6, wherein the lock is made of titanium or steel.

13. A gas turbine engine comprising a fan according to claim 1.

14. The fan according to claim 2, wherein the pin protrudes from a downstream radial face of the downstream edge of the lock, the pin being integrally formed with the downstream edge of the lock.

* * * * *